US010752458B2

(12) United States Patent
Wind et al.

(10) Patent No.: US 10,752,458 B2
(45) Date of Patent: Aug. 25, 2020

(54) AUTOMATIC ROLLER CLAMP

(71) Applicant: Océ Holding B.V., Venlo (NL)

(72) Inventors: Anne A. Wind, Venlo (NL); Thijs Den Hertog, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 315 days.

(21) Appl. No.: 15/855,206

(22) Filed: Dec. 27, 2017

(65) Prior Publication Data

US 2018/0186589 A1 Jul. 5, 2018

(30) Foreign Application Priority Data

Jan. 4, 2017 (EP) ..... 17150251

(51) Int. Cl.
*B65H 16/02* (2006.01)
*B65H 16/08* (2006.01)

(52) U.S. Cl.
CPC ..... *B65H 16/028* (2013.01); *B65H 16/08* (2013.01); *B65H 2301/41358* (2013.01); *B65H 2402/31* (2013.01); *B65H 2404/1521* (2013.01); *B65H 2404/433* (2013.01); *B65H 2405/462* (2013.01); *B65H 2511/212* (2013.01); *B65H 2515/30* (2013.01); *B65H 2701/1842* (2013.01); *B65H 2801/36* (2013.01)

(58) Field of Classification Search
CPC ..... B65H 16/028; B65H 16/08; B65H 2301/41358; B65H 2402/31; B65H 2404/1521; B65H 2404/433; B65H 2405/462; B65H 2511/212; B65H 2515/30; B65H 2701/1842; B65H 2801/36
See application file for complete search history.

(56) References Cited

U.S. PATENT DOCUMENTS 2,834,558 A * 5/1958 Halpin ..... B65H 16/005 242/527.5
2,997,248 A * 8/1961 Chase ..... B65H 19/1821 242/420.3

(Continued)

FOREIGN PATENT DOCUMENTS

DE 3218545 C2 9/1986

OTHER PUBLICATIONS

European Search Report for EP 17 15 0251 completed on Jun. 30, 2017.

*Primary Examiner* — Michael E Gallion
(74) *Attorney, Agent, or Firm* — Birch, Stewart, Kolasch & Birch, LLP

(57) ABSTRACT

A media roll holder assembly a web-based printing system comprises a support for rotatably supporting the roll in an operative position, a holding element for rotatably holding the roll on the support, and a pivotable arm on which the holding element is provided. The pivotable arm is formed and positioned to position the holding element on the roll, such that a lifting force for lifting the roll from the support results in a holding force on the holding element in the first angular direction for holding the roll in the operative position on the support. The roll is then rotatably secured in its operative without excess angular forces acting on the roll. As the rotation of the roll is substantially unimpeded, the medium may be transported with great precision, resulting in high quality printing.

21 Claims, 6 Drawing Sheets

(56) References Cited

U.S. PATENT DOCUMENTS

| | | | | |
|---|---|---|---|---|
| 3,931,940 | A * | 1/1976 | Raighn | B65H 16/08 242/527.6 |
| 4,084,761 | A * | 4/1978 | Kuckhermann | B65H 16/08 242/559 |
| 5,029,827 | A * | 7/1991 | Smith | B65H 16/10 270/30.11 |
| 6,343,884 | B1 * | 2/2002 | Watanabe | B41J 11/703 400/578 |
| 9,073,718 | B2 * | 7/2015 | Chen | B65H 20/00 |
| 2009/0179103 | A1 * | 7/2009 | Martin | B65B 13/18 242/422.6 |
| 2011/0192930 | A1 | 8/2011 | Horikawa | |
| 2015/0328906 | A1 * | 11/2015 | Sumioka | B65H 16/08 242/564.5 |
| 2016/0001997 | A1 * | 1/2016 | Maddaleni | B65H 19/30 242/523.1 |
| 2016/0136980 | A1 * | 5/2016 | Kobayashi | B41J 15/04 347/104 |
| 2019/0168979 | A1 * | 6/2019 | Morelli | B65H 19/2269 |

* cited by examiner

Fig. 1A
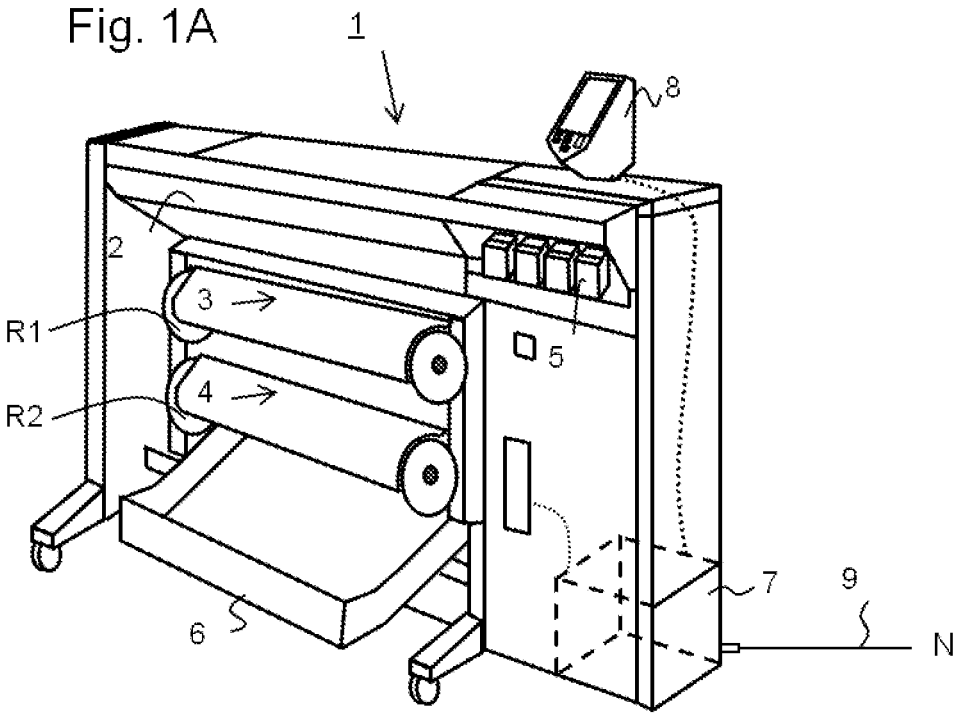
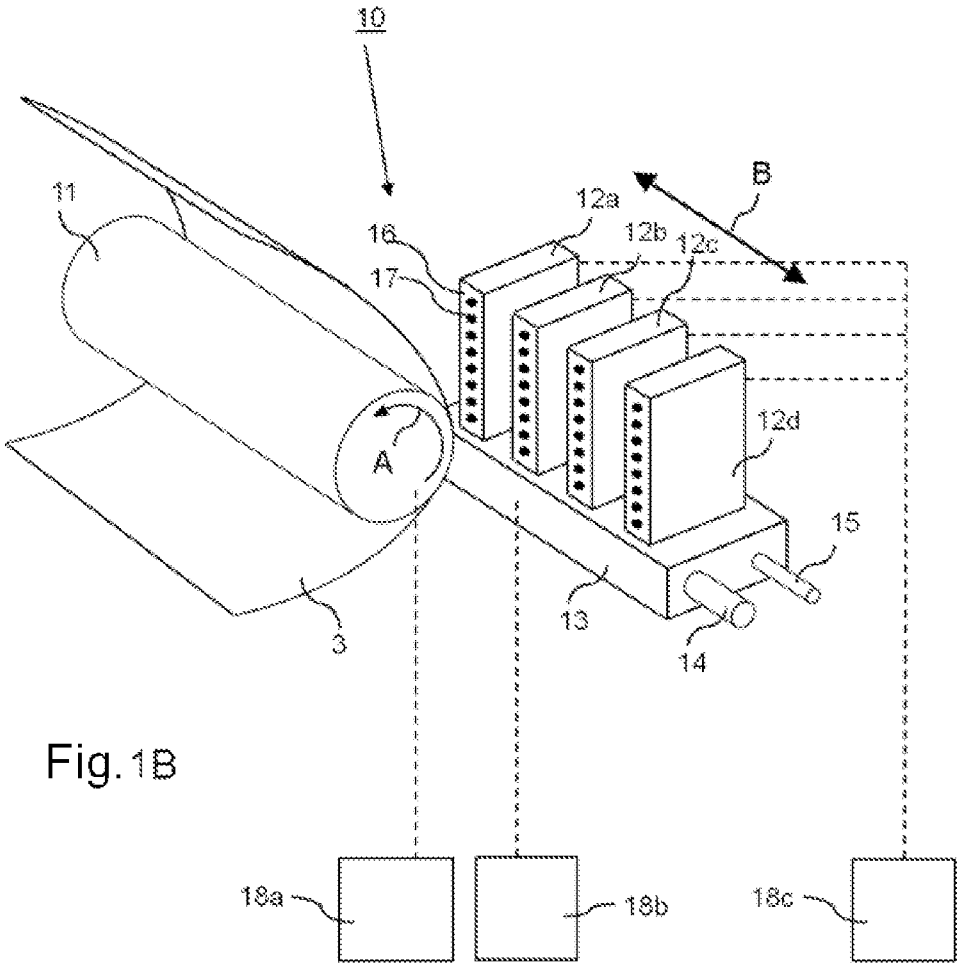
Fig. 1B

AUTOMATIC ROLLER CLAMP

FIELD OF THE INVENTION

The present invention generally pertains to a media roll holder assembly, a printing system, and a method for holding a roll for winding web-based media during printing.

BACKGROUND ART

For web-based printing media are fed into the printing system from a media roll supported in a media roll holder. The media roll holder rotatably holds the media roll in an operative position while the media roll is unspooled towards the print heads. To ensure accurate positioning of the medium with respect to the print heads, the media roll needs to be securely held against pulling forces acting on the roll from the printing system via the unwound medium. It is known from DE3218545C2 to apply three concentrically positioned wheels around the media roll, wherein a top wheel is provided with a spring for urging the top wheel against the media roll. Thereby, the media roll is urged against the remaining wheels. A disadvantage of the known media roll holder is that the media roll may still be able to move under the influence of relatively large forces. A larger pretension in the spring may be applied, but this results in excess forces in the media roll as well as a very large force to be overcome when opening the media roll holder for loading a new media roll. The pretension continually acts on the roll and may hamper the rotation of the media roll, as the forces on the roll may become sufficiently large to affect its rotation. The medium can then no longer be transported with sufficient precision, which may result in reduced print quality or print artifacts.

SUMMARY OF THE INVENTION

It is an object of the present invention to provide an easy to use media roll holder assembly for securely holding rolls in a printing system without affecting the print quality.

The present invention provides a media roll holder assembly for a roll that is detachably supported in a printing system, the assembly comprising:

- a support positioned to support the roll in an operative position, such that the roll is arranged to rotate around a rotation axis;
- a holding element positionable in a holding position at a periphery of the roll to engage the roll at a contact point for rotatably holding the roll on the support;
- a pivotable arm on which the holding element is provided, the pivotable arm being configured to pivot around a pivot axis, wherein:

the holding element in the holding position is positioned at an angle of at least 180° from the pivot axis as measured around the rotation axis in a first pivoting direction wherein the holding element moves towards the rotation axis.

The pivotable arm extends between the pivot axis and the holding element over at least a semi-circle. In consequence any lifting force on the roll, results in the holding element being effectively pressed onto the roll as illustrated in the force diagram in FIG. 4. The holding force of the holding element is derived from the lifting force, so in absence of a lifting force the holding element exerts substantially no force on the roll. Further, no urging devices are required to provide the holding force. In this manner the holding element only exerts a force on the roll when needed. Thereby any deformation or indentation of the web medium by the holding element is reduced. In consequence, the chance of print artifacts due to local deformations in the web medium is decreased. Further, since the holding element only exerts a force on the roll when needed, friction from the holding element on the roll is reduced, allowing for a more accurate control of the step size of the web transport. This reduces print artifacts due to improperly overlapping swaths in the printed image. Thus, the object of the present invention has been achieved.

More specific optional features of the invention are indicated in the dependent claims.

In an embodiment, during use the support supports a lower half of the roll and the holding element in the holding position is positioned at a top half of the roll. The roll rests on the support under the influence of gravity. The support is preferably positioned in a predetermined angular range as measured around the rotation axis. The pivot axis is then preferably positioned within the same angular range, for example near or below the support. The pivotable arm positions the holding element at least 180° from the pivot axis by e.g. extending around the roll over the latter angle.

In an embodiment, the holding element in the holding position is positioned on a first or top side of a horizontal plane extending through the rotation axis. The support and the pivot axis are positioned on a second or bottom side of said plane opposite to the first side.

In a preferred embodiment, the pivotable arm is substantially rigid, i.e. able to withstand deformation due to forces acting on it. The rigid arm is arranged to handle relatively large forces and allows for a relatively simple construction. It will further be appreciated that the transport path is formed by the path the medium travels when after being unwound from the roll. The transport path thus starts where the medium is unwound and is released from the roll.

In an embodiment, the pivotable arm is configured, such that a lifting force on the roll in the feeding direction results in a holding force on the holding element in the holding position in a first angular direction. This holding force then urges the pivotable arm in the first pivoting direction, thereby urging the holding element against the roll. The urging results in a clamping of the roll between the holding element and the support. Advantageously the holding force acts only when a lifting force is present. No excess forces are thus exerted on the roll when it is not required, ensuring a smooth and well-controlled rotation of the roll. Accurate control of the roll's rotation allows for higher print quality as the medium may be positioned very accurately.

In a further embodiment, the pivotable arm is configured to pivot around the pivot axis, such that in a first pivoting direction the distance between the holding element and the rotation axis of the roll is decreased. By appropriately positioning the pivot axis in the angular pivot axis range, the lifting force is redirected into a holding force which urging the holding element in a direction with a component opposite to the lifting force. For example, when the roll experiences an upwards lifting force, the assembly according to the present invention ensures that in reaction the holding element is urged downwards. Thereby, the roll is securely held in place without requiring additional holding forces to be present on the roll when such forces are not required. It will be appreciated that it is preferred that the first angular direction and the first pivoting direction are substantially similar, meaning that both imply a rotation in the roughly or substantially same angular direction around the rotation axis.

In another embodiment, the pivot axis is positioned angularly between the central plane and the holding plane opposite to the holding element with respect to the rotation axis. A pivoting plane extending through the pivot axis and the rotation axis is thereby positioned in an angular range between the holding plane and the central plane. This positions the pivot axis substantially opposite to the holding element with respect to the rotation axis and allows for a compact configuration. In another embodiment, the holding element and the pivot axis are on opposite sides of a horizontal plane extending through the rotation axis. Likewise the support is preferably on an opposite or bottom side of said horizontal plane with respect to the holding element.

In another embodiment, the pivotable arm is further configured to pivot around a pivot axis, such that in a second pivoting direction the distance between the holding element and the rotation axis of the roll is increased. This allows the operator to easily load or unload a roll by pivoting the holding element away from the roll.

In an embodiment, a pivot axis of the pivotable arm and a rotation axis of the roll in the operative position define a central plane, such that the pivotable arm extends from the pivot axis along a first side with respect to the central plane, through the central plane, to a second side with respect to the central plane such that the pivotable arm positions the holding element at the periphery of the roll in the holding position. Basically, the pivotable arm extends in a straight or curved line from the pivot axis below the roll to a first point positioned on the first side of the central plane away from the periphery of the roll. The pivotable arm further extends in a straight or curved line from the first point to a second point at or near the periphery of the roll. Thereby, the pivotable arm positions the holding element in its holding position at or on the periphery of the roll. The pivotable arm thus extends in the angular range defined by the second angle between the pivot axis and the holding element with respect to the rotation axis of the roll. Preferably, the first point is positioned beyond the periphery of the roll to provide additional leverage.

In another embodiment, a pivot axis of the pivotable arm and a rotation axis of the roll in the operative position define a central plane, such that the pivotable arm extends from the pivot axis partially around the roll along a first side with respect to the central plane, through the central plane, to a second side with respect to the central plane. Alternatively, the central plane may be defined as extending in the feeding direction through the rotation axis of the roll in the operative position. The pivotable arm curves around the roll on one side of the central plane over more than 180° to position the holding element on the other side of the central plane. Thereby, the pivotable arm with the holding element engages and clamps the roll against the support when the roll experiences a lifting force urging the roll away from the support.

In an embodiment, the pivotable arm comprises a semicircular portion or section for during use enclosing an half of the roll. In another embodiment, the majority of the pivotable arm extends on the first side with respect to the central plane. The holding element is then positioned on the second side, while the pivotable arm extends in a semicircle or C-shape along the first side. The support extends through the central plane, extending from the first side to the second side. The rigid pivotable arm thus provides a secure means of holding the roll in place.

In another embodiment, a pivot axis of the pivotable arm is positioned within an angular range of the support with respect to a rotation axis of the roll in an operative position. The pivot axis is then positioned near the support, specifically below the support. The support may in a further embodiment comprise a pair of angularly spaced apart support wheels or rollers, wherein the pivot axis is positioned angularly between the support wheels, when viewed along the pivot axis or rotation axis. Under the influence of gravity the roll then rests stably on the support. The pivotable arm then extends around the roll to position the holding element above the roll concentrically with respect to the support wheels. Thereby, the roll is rotatably secured by the media roll holder according to the present invention.

In a further embodiment, the holding element is positioned angularly offset with respect to a top point positioned on a periphery of the roller opposite to a pivot axis of the pivotable arm with respect to a rotation axis of the roll in an operative position. The pivot axis is positioned vertically below the roll, preferably below the lowest point on the roll's periphery. The top point, being the highest point on the roll's periphery, is then positioned on an opposite side of the roll with respect to the roll's rotation axis. The pivotable arm then extends from the pivot axis below the roll along one side of the roll (for example the right side) to position the holding element on the roll's periphery spaced apart from the top position and the other side of the roll (the left side in the latter example). Thereby, a second angle between the pivot axis and the holding element, measured around the rotation axis, is more than a semicircle, i.e. larger than 180°, but preferably less than 270°.

In another embodiment, the pivotable arm is curved, such that it angularly extends from a pivot axis of the pivotable arm the around the roll over a second angle between 180° and 270° with respect to a rotation axis of the roll in the operative position. The rigid pivotable arm preferably comprises a C-shape extending around the roll.

In an even further embodiment, the support comprises a pair of rotatable support wheels angularly spaced apart from one another with respect to a rotation axis of the roll in the operative position. The support wheels provide a low friction bearing support for the roll. By positioning the support wheels on opposite sides of a vertical axis, e.g. the central plane, through the rotation axis of the roll, the roll may be stably positioned on the support wheels under the influence of gravity. Thus, a simple and low cost support is provided with little resistance to the rotation of the roll.

In a preferred embodiment, the holding element is in low friction or frictionless contact with the roll. Thereby, any forces exerted by the holding element on the roll are reduced as not to affect the rotational motion of the roll. The roll's rotation may thus be controlled with great precision, resulting in high image quality. In another embodiment, the holding element comprises a holding wheel provided rotatable on the pivotable arm. The holding wheel is arranged to roll over the periphery of the roll without impeding the rotation of the roll, e.g. by exerting friction or drag forces on the roll. As such, the holding wheel ensures that the reaction force induced in response to the lifting force on the roll, is radially directed to the rotation axis of the roll. The difference in the direction of the lifting forces and the reaction force results in the holding force driving the holding wheel in the first angular direction. Thereby, the roll is securely held in place without hampering its rotation. As an image is generally printed in consecutive swaths on the medium, any deviation in de stepping transport of the medium could result in print artifacts, such as lateral line due to poor overlap of two consecutively printed swaths. In the above manner, the medium may transported unhampered and thus with high accuracy.

In a further embodiment, the pivotable arm is arranged to pivot between an open position for loading a roll onto the support and a holding position wherein the holding element holds the roll in operative position. This allows for easy loading and unloading of the roll. In the holding position, the holding wheel and the support wheels are concentrically positioned around the rotation axis of the roll to rotatably hold the roll in the operative position. For loading a new roll, the pivotable arm is pivoted such that the holding element pivots away from the support wheels in the second pivoting direction. The roll is then free of the holding wheel and may be lifting from the support. For printing, the holding wheel is pivoted back onto the periphery of the roll.

In another embodiment, the media roll holder assembly further comprises a releasable lock for locking the pivotable arm in the holding position. The lock acts as a safety to prevent unintended release of the pivotable arm from the holding position during printing.

In a further embodiment, the media roll holder assembly according to the present invention further comprises an urging element for urging the pivotable arm into the holding position, specifically when the roll is at rest or free of pulling forces. The urging element aids in driving the holding element in the first pivoting direction in absence of a lifting force on the roll. Thereby, the roll is rotatably secured during interruptions in the transport of the medium. The urging force of the urging element is preferably selected to be relatively small as not to affect the rotation of the roll.

In an even further embodiment, the media roll holder assembly according to the present invention, further comprises a stop element for contacting the pivotable arm to limit a pivoting range of the pivotable arm. The stop element determines the position of the holding element in the holding position. As such, the holding wheel may be positioned concentrically to the rotation axis along with the support wheels. Concentrically herein is defined as the wheels being positioned at different angular positions on a common circle around the rotation axis of the roll, for example at the periphery of the roll. When the holding force drives the holding element in the first angular direction, the stop element provides an opposing stop force on the pivotable arm. Thereby, an increased pressure or force of the holding element on the roll is prevented, such that the roll may continue to rotate substantially unimpeded by additional friction force due to the holding element. In this manner excess forces on the roll are prevented whilst still maintaining a secure holding of the roll on the support.

In another embodiment, the media roll holder assembly according to the present invention further comprises a transport path for feeding media from the roll into the printing system, wherein the pivotable arm is positioned laterally to a side of the transport path, wherein the support and a pivot axis for the pivotable arm are positioned below the roll with respect to the transport path, and wherein the pivotable arm is curved partially around the roll from the pivot axis past the highest point on the roll with respect to the transport path. The feeding direction of the transport path is herein defines taken as the upward direction, i.e. any reference to the upward feeding direction not need be taken as being vertical but may depend on the actual feeding direction of the medium from the roll (which in practice in generally substantially vertically upwards). Below the roll is herein meant as on a side of the roll opposite to the transport path. The transport path extends away from the roll to the image forming unit with the print heads. The direction of the transport path defines the direction wherein the medium leaves the medium roll. The transport direction is preferably aligned with the central plane, though in practice the transport direction may be angularly oriented anywhere in an angular range between the holding element and the central plane. Thereby, the pivotable arm extends around the roll over the highest point on the roll to provide its clamping action on the roll. In a further embodiment, the holding element and the pivot axis are positioned on opposite sides of a central plane extending through the rotation axis of the roll in the feeding direction, such that the pivotable arm extends through the central plane to position the holding element in the holding position on the roll.

In another aspect of the present invention, a media roll holder assembly for a roll that is detachably supported in a printing system is provided. Said media roll holder assembly comprises:

- a support positioned to support the roll in an operative position, such that the roll is arranged to rotate around a rotation axis;
- a transport path positioned opposite of the support with respect to the rotation axis, which transport path extends from the roll in a feeding direction for feeding a medium to the printing system;
- a holding element positionable in a holding position at a periphery of the roll to engage the roll at a contact point for rotatably holding the roll on the support;
- a pivotable arm on which the holding element is provided, the pivotable arm being configured to pivot around a pivot axis, wherein, when the holding element is positioned in the holding position, the holding element is positioned angularly offset with respect to a central plane at a first angle around the rotation axis, which central plane extends in the feeding direction and through the rotation axis;

the pivot axis is positioned at a second angle around the rotation axis with respect to the holding element in the holding position, the pivot axis thereby being positioned in an angular pivot axis range which angular pivot range extends angularly on a side of a holding plane with respect to the rotation axis, which holding plane extends through the rotation axis and the contact point.

In a basic example, the lifting force (or the direction wherein the web leaves the roll) is the vertical direction. During operation, the roll rests on the support, such that the roll may rotate around its rotation axis. The pivotable arm then positions the holding element in its holding position on the periphery of the roll. The holding position is angularly offset with respect to a central (and in this example vertical) plane. The feeding direction of the web is the vertical direction. When the roll experiences a lifting force via the medium being unspooled from it, e.g. by means of a pulling force from the printing system, this lifting force induces a holding force on the holding element. Since the holding element is angularly offset to the feeding direction, this holding force forces the holding element in a first angular direction (roughly in the same direction as the first pivoting direction) around the rotation axis. As the holding element is provided on the pivotable arm, the pivotable arm is consequently urged in the first pivoting direction. By selecting the pivot axis to lie in the angular range on one side of the holding plane, the holding element via the pivoting arm is driven against the roll, clamping the roll onto the support. This ensures a secure holding of the roll while printing. The holding force results from a reaction force due to the lifting force and is thus proportional to the lifting force, such that at all times the holding force on the roll is sufficient to prevent displacement of the roll. An accurate positioning of the roll provides highly accurate stepping of the print medium. This, in turn, allows for high quality printing. The roll may further be easily loaded or unloaded by pivoting the holding element in the second pivoting direction away from the roll.

In a further aspect, the present invention provides a printing system for printing web media, comprising a media roll holder according to the present invention.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given herein below and the accompanying schematical drawings which are given by way of illustration only, and thus are not limitative of the present invention, and wherein:

FIG. 1A is a schematic perspective view of a printing system according to the present invention;

FIG. 1B is a schematic perspective view of an image forming unit of the printing system in FIG. 1A;

DETAILED DESCRIPTION OF THE DRAWINGS

Figure 2:
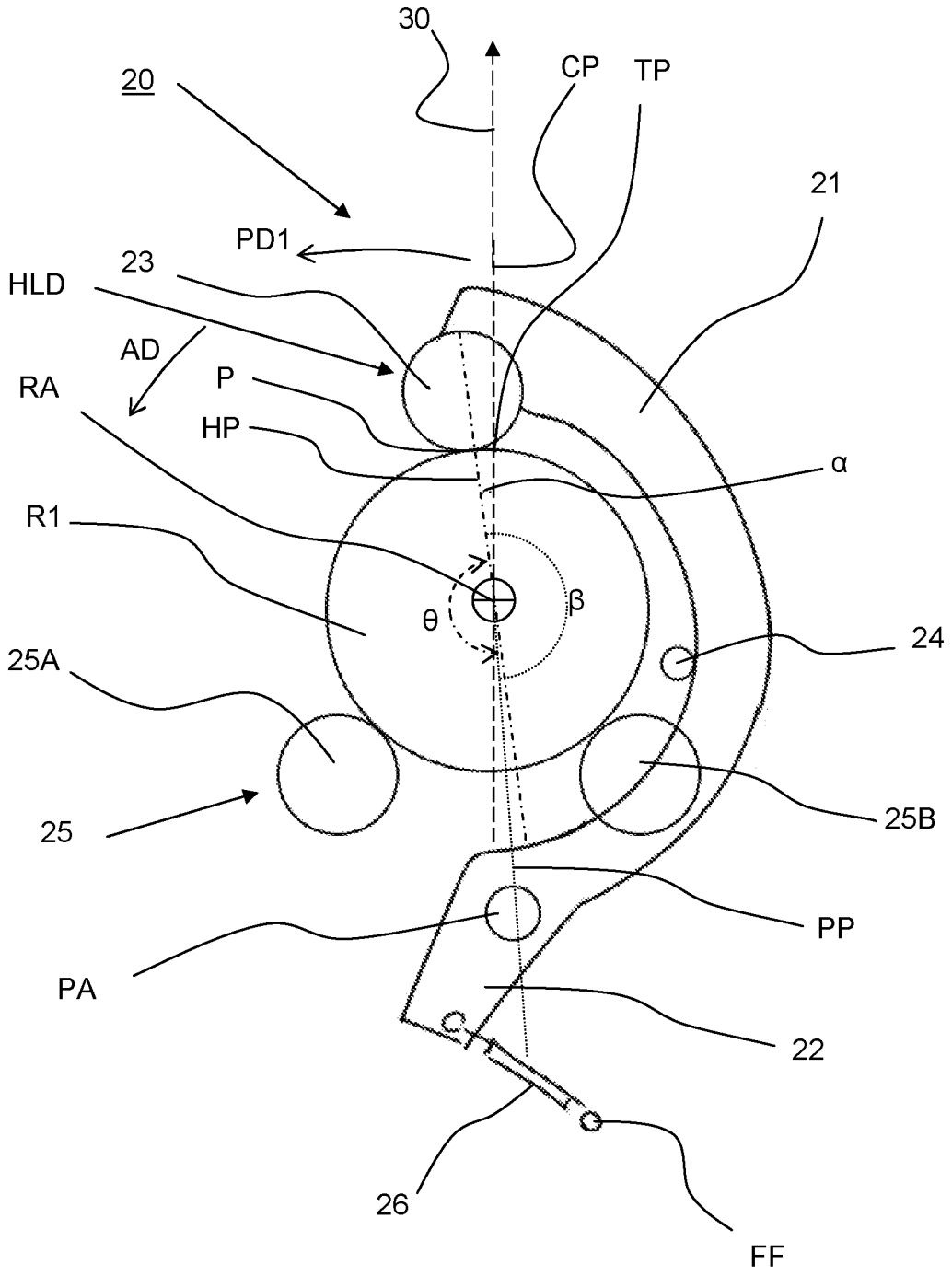
FIG. 2 is a schematic side view of a media roll holder assembly according to the present invention during operation.

The present invention will now be described with reference to the accompanying drawings, wherein the same reference numerals have been used to identify the same or similar elements throughout the several views.

FIG. 1A shows an image forming apparatus 1, wherein printing is achieved using a wide format inkjet printer. The wide-format image forming apparatus 1 comprises a housing 2, wherein the printing assembly, for example the ink jet printing assembly shown in FIG. 1B is placed. The image forming apparatus 1 also comprises a storage means for storing image receiving member 3, 4, a delivery station to collect the image receiving member 3, 4 after printing and storage means 5 for marking material. In FIG. 1A, the delivery station is embodied as a delivery tray 6. Optionally, the delivery station may comprise processing means for processing the image receiving member 3, 4 after printing, e.g. a folder or a puncher. The wide-format image forming apparatus 1 furthermore comprises means for receiving print jobs and optionally means for manipulating print jobs. These means may include a user interface unit 8 and/or a control unit 7, for example a computer.

Images are printed on a image receiving member, for example paper, supplied by a roll 3, 4. The roll 3 is supported on the roll support R1, while the roll 4 is supported on the roll support R2. Alternatively, cut sheet image receiving members may be used instead of rolls 3, 4 of image receiving member. Printed sheets of the image receiving member, cut off from the roll 3, 4, are deposited in the delivery tray 6.

Each one of the marking materials for use in the printing assembly are stored in four containers 5 arranged in fluid connection with the respective print heads for supplying marking material to said print heads.

The local user interface unit 8 is integrated to the print engine and may comprise a display unit and a control panel. Alternatively, the control panel may be integrated in the display unit, for example in the form of a touch-screen control panel. The local user interface unit 8 is connected to a control unit 7 placed inside the printing apparatus 1. The control unit 7, for example a computer, comprises a processor adapted to issue commands to the print engine, for example for controlling the print process. The image forming apparatus 1 may optionally be connected to a network N. The connection to the network N is diagrammatically shown in the form of a cable 9, but nevertheless, the connection could be wireless. The image forming apparatus 1 may receive printing jobs via the network. Further, optionally, the controller of the printer may be provided with a USB port, so printing jobs may be sent to the printer via this USB port.

FIG. 1B shows an ink jet printing assembly 10. The ink jet printing assembly 10 comprises supporting means for supporting an image receiving member 3. The supporting means 11 are shown in FIG. 1B as a platen 11, but alternatively, the supporting means 11 may be a flat surface. The platen 11, as depicted in FIG. 1B, is a rotatable drum 11, which is rotatable about its axis as indicated by arrow A. The supporting means 11 may be optionally provided with suction holes for holding the image receiving member 3 in a fixed position with respect to the supporting means 11. The ink jet printing assembly 10 comprises print heads 12*a*-12*d*, mounted on a scanning print carriage 13. The scanning print carriage 13 is guided by suitable guiding means 14, 15 to move in reciprocation in the main scanning direction B. Each print head 12*a*-12*d* comprises an orifice surface 16, which orifice surface 16 is provided with at least one orifice 17. The print heads 12*a*-12*d* are configured to eject droplets of marking material onto the image receiving member 3. The platen 11, the carriage 13 and the print heads 12*a*-12*d* are controlled by suitable controlling means 18*a*, 18*b* and 18*c*, respectively.

The image receiving member 3 may be a medium in web or in sheet form and may be composed of e.g. paper, cardboard, label stock, coated paper, plastic or textile. Alternatively, the image receiving member 3 may also be an intermediate member, endless or not. Examples of endless members, which may be moved cyclically, are a belt or a drum. The image receiving member 3 is moved in the sub-scanning direction A by the platen 11 along four print heads 12*a*-12*d* provided with a fluid marking material.

A scanning print carriage 13 carries the four print heads 12*a*-12*d* and may be moved in reciprocation in the main scanning direction B parallel to the platen 11, such as to enable scanning of the image receiving member 3 in the main scanning direction B. Only four print heads 12*a*-12*d* are depicted for demonstrating the invention. In practice an arbitrary number of print heads may be employed. In any case, at least one print head 12*a*-12*d* per color of marking material is placed on the scanning print carriage 13. For example, for a black-and-white printer, at least one print head 12*a*-12*d*, usually containing black marking material is present. Alternatively, a black-and-white printer may comprise a white marking material, which is to be applied on a black image-receiving member 3. For a full-color printer, containing multiple colors, at least one print head 12*a*-12*d* for each of the colors, usually black, cyan, magenta and yellow is present. Often, in a full-color printer, black marking material is used more frequently in comparison to differently colored marking material. Therefore, more print heads 12*a*-12*d* containing black marking material may be provided on the scanning print carriage 13 compared to print heads 12*a*-12*d* containing marking material in any of the other colors. Alternatively, the print head 12*a*-12*d* containing black marking material may be larger than any of the print heads 12*a*-12*d*, containing a differently colored marking material.

The carriage 13 is guided by guiding means 14, 15. These guiding means 14, 15 may be rods as depicted in FIG. 1B. The rods may be driven by suitable driving means (not shown). Alternatively, the carriage 13 may be guided by other guiding means, such as an arm being able to move the carriage 13. Another alternative is to move the image receiving material 3 in the main scanning direction B.

Each print head 12*a*-12*d* comprises an orifice surface 16 having at least one orifice 17, in fluid communication with a pressure chamber containing fluid marking material provided in the print head 12*a*-12*d*. On the orifice surface 16, a number of orifices 17 is arranged in a single linear array parallel to the sub-scanning direction A. Eight orifices 17 per print head 12*a*-12*d* are depicted in FIG. 1B, however obviously in a practical embodiment several hundreds of orifices 17 may be provided per print head 12*a*-12*d*, optionally arranged in multiple arrays. As depicted in FIG. 1B, the respective print heads 12*a*-12*d* are placed parallel to each other such that corresponding orifices 17 of the respective print heads 12*a*-12*d* are positioned in-line in the main scanning direction B. This means that a line of image dots in the main scanning direction B may be formed by selectively activating up to four orifices 17, each of them being part of a different print head 12*a*-12*d*. This parallel positioning of the print heads 12*a*-12*d* with corresponding in-line placement of the orifices 17 is advantageous to increase productivity and/or improve print quality. Alternatively multiple print heads 12*a*-12*d* may be placed on the print carriage adjacent to each other such that the orifices 17 of the respective print heads 12*a*-12*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 17.

Upon ejection of the marking material, some marking material may be spilled and stay on the orifice surface 16 of the print head 12*a*-12*d*. The ink present on the orifice surface 16, may negatively influence the ejection of droplets and the placement of these droplets on the image receiving member 3. Therefore, it may be advantageous to remove excess of ink from the orifice surface 16. The excess of ink may be removed for example by wiping with a wiper and/or by application of a suitable anti-wetting property of the surface, e.g. provided by a coating.

FIG. 2 illustrates a media roll holder assembly 20 according to the present invention. The media roll holder assembly 20 rotatably secures the roll R1 during printing, such that the roll R1 retains its operative position on the support 25. The roll R1 is preferably a roll support R1 around which print media is wound or a roll support core R1 arranged for being provided into and supporting a cylinder core around which the medium is wound. During printing the web media is unspooled from the roll R1 along the transport path into the printing system 1 for printing on said media. The roll R1 during printing is held in its operative position due to a holding element 23 mounted on a pivotable arm 21. The pivotable arm 21 curves around the roll R1 in such a manner that a lifting force in the direction of the transport path results in a reaction holding force urging the holding element 23 in a first angular direction AD. The pivoting arm 21 is then driven in the first pivoting direction PD1. As in this direction PD1, the holding element 23 is driven closer to the rotation axis of the roll R1, the holding element 23 is forced onto the roll R1. As such, the holding element 23 rotatably secures the roll R1 while printing. A well defined position of the roll R1 during printing allows for accurate stepping or moving of the media, thereby increasing the print quality.

In FIG. 2, the holding element 23 of the media roll holder assembly 20 is in its holding position HLD on the periphery of the roll R1 in its operative position during printing. There the holding element 23 contacts the roll R1 at the contact point P. The pivotable arm 21 is arranged to pivot the holding element 23 between the holding position HLD in FIG. 2 and an open position which will be discussed further on with respect to FIG. 3. The support 25 in FIG. 2 comprises a pair of support wheels or rollers 25A, 25B, which are positioned to allow the roll R1 to rotate around its rotation axis RA. The support wheels 25A, 25B are preferably rotatable. Their positions may be adjustable in correspondence to a diameter of the roll support R1, though generally a single roll support diameter is applied. The media roll holder assembly 20 is positioned laterally to the side of the web media on the roll support R1, such that it engages the roll support R1 in regions not covered by print media. In one embodiment, one or more support wheels 25A, 25B comprise an actuator for driving a rotation of the roll R1. In a preferred embodiment, the rotation of the roll R1 is actuated via a separate actuating gear wheel which engages a corresponding gear at the end of the roll R1. In FIG. 2, the support wheels 25A, 25B and the holding element 23 are positioned concentrically around the rotation axis RA to rotatably secure the roll R1 in its operative position. This positioning is not mirror symmetric with respect to a central plane through the rotation axis of the roll, since the angle between the left support wheel 25A and the holding element 23 is smaller than the angle between the right support wheel 25A and the holding element 23.

FIG. 2 schematically illustrates the central plane CP extending in the feeding direction 30 parallel to the transport path. The central plane CP further extends to the rotation axis RA. In the example shown in FIG. 2, the feeding direction 30 is directed vertically upwards. The holding element 23 is positioned angularly offset or spaced apart from the central plane CP, specifically at the first angle $\alpha$. The first angle $\alpha$ in FIG. 2 is indicated an angle between the central plane CP and a holding plane HP extending through the rotation axis RA and the contact point P. It will be appreciated that the first angle $\alpha$ is a non-zero angle, preferably relatively small, e,g, less than 30°, specifically less than 10°. On one side of the holding plane HP, the pivot axis angular $\theta$ is indicated. The pivot axis is positioned substantially on the second side (right side in FIG. 2) of the central CP. This due to the fact that the pivoting arm 21 extends from the pivot axis PA in the first angular direction AD to the holding element 23 in the holding position HLD. The pivoting arm 21 extends then over the second angle $\beta$, which is in FIG. 2 is over 180° to position the pivot axis PA inside the pivot axis angular θ. In the preferred embodiment in FIG. 2, the second angle β angularly positions the pivot axis between the central plane CP and the holding plane HP. In FIG. 2, a pivoting plane PP extending through the rotation axis RA and the pivot axis PA is indicated to illustrate the intermediate position of the pivot axis PA between the central plane CP and the holding plane HP.

FIG. 2 further illustrates the holding element 23 which in FIG. 2 is formed by a holding wheel or roller 23. The holding element 23 is provided rotatable or moveable on the pivotable arm 21 to allow for frictionless movement of the holding element 23 over the roll support R1. The pivotable arm 21 is arranged to pivot around its pivot axis PA, which is angularly positioned in between the support wheels 25A, 25B. The pivot axis PA as well as the support 25 is positioned on the bottom side of the roll support R1. The up direction herein is defined as the feeding direction 30 of the transport path from the media roll holder assembly 20 to the printing system 1. The pivotable arm 21 extends from the pivot axis PA on the bottom side of the roll R1 around the roll R1 over the highest or top point TP of the roll R1 to the contact point P where the holding element 23 engages the roll R1. The pivotable arm 21 in FIG. 2 is curved as a C-shape, which extends over more than a semicircle around the rotation axis RA. The pivotable arm 21 curves around the rotation axis RA over the second angle β, which has a value of more than 180° and less than 270°. In FIG. 2, the second angle β angularly positions the holding element at a little over 180° from the pivot axis PA. The position of the pivot axis PA and/or the pivotable arm 21 is shaped, such that the pivotable arm 21 is arranged to pivot in a first pivoting direction PD1 to decrease the distance between the holding element 23 and the roll R1, specifically its periphery or rotation axis RA. Pivoting the pivoting arm 21 in the first pivoting direction PD1 urges the holding element 21 onto the roll R1, thereby pressing or clamping the roll R1 onto the support wheels 25A, 25B.

A stop element 24 is provided to restrict the pivoting movement of the pivotable 21 in the first pivoting direction PD1. Thereby, the stop element 24 defines the angular position of the holding element 23 on the roll support R1. The stop element 24 ensures that the holding element 23 secures the roll support R1 in its operative position without exerting excess force. In this manner additional friction on the roll R1 is prevented, allowing for an accurately controlled stepping motion of the roll R1.

To facilitate easy loading of the roll support R1 into the media roll holder assembly 20, an urging element 26 is provided. The urging element 26, which may be spring 26, is connected at one end to the fixed frame FF of the printing system 1 and at the other end to an urging arm 22 connected to the pivotable arm 21. The pivotable arm 21 and the urging arm 22 are preferably integrally formed, but are positioned at opposite sides with respect to the pivot axis PA. The spring or piston 26 ensures the holding element 23 remains in the holding position HLD in absence of a lifting force. When loading a new roll support R1, the urging element automatically drives the pivotable arm 21 in the first pivoting direction PD1 to position the holding element 23 in its holding position HLD, as shown in FIG. 2. As such, the loading of a new roll support R1 may be performed in a single motion by an operator or loading device, thereby improving the overall workflow and productivity of the printing system 1. It will be appreciated that the urging force may be relatively small, as any lifting force on the roll R1 automatically results in an additional reactive holding force. The stop element 24 prevents the holding element 23 from being pressed to hard onto the roll R1. This reduces the angular friction on the roll R1 resulting in more accurate control of the rotation of the roll R1, and in consequence a higher print quality.

Figure 3:
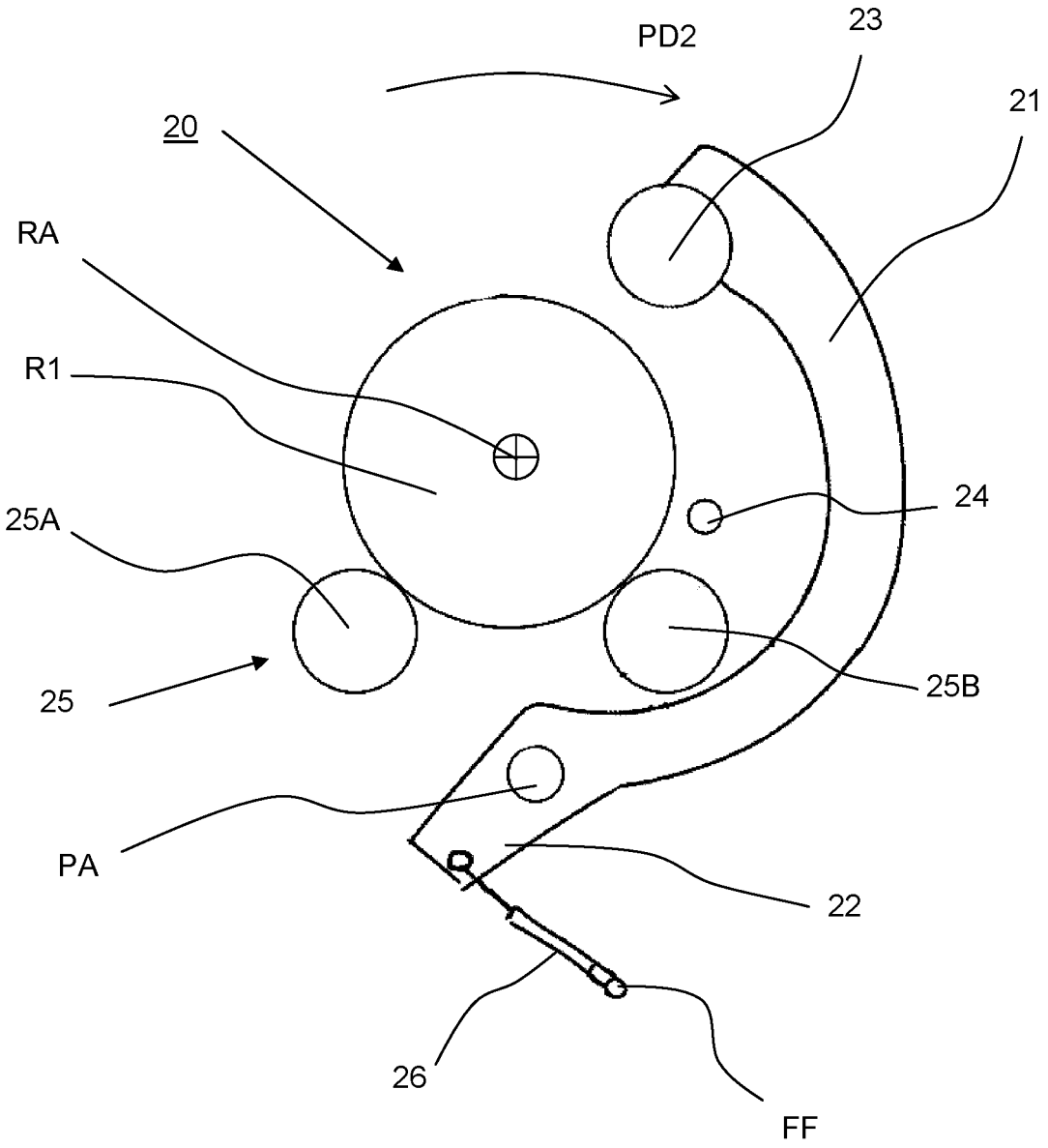
FIG. 3 is a schematic side view of the media roll holder assembly of FIG. 2 in the open position.

FIG. 3 illustrates the media roll holder assembly 20 with the holding element 23 in its open position to facilitate the loading of a new roll R1 onto the support 25. With respect to FIG. 2, the pivotable arm 21 has pivoted around its pivot axis PA in the second pivoting direction PD2 away from the stop element 24. Thereby, the holding element 23 is pivoted away from the roll R1 to allow loading or unloading of a roll R1. In FIG. 3, the support wheels 25A, 25B and the holding element 23 are no longer positioned concentrically around the rotation axis RA, as the pivotable arm 21 positions the holding element 23 away from the roll R1. In a preferred embodiment, the media roll holder assembly 20 comprises an actuator such as a handle or switch to aid the operator in moving the holding element 23 to its open position against the force of the urging element 26.

Figure 4:
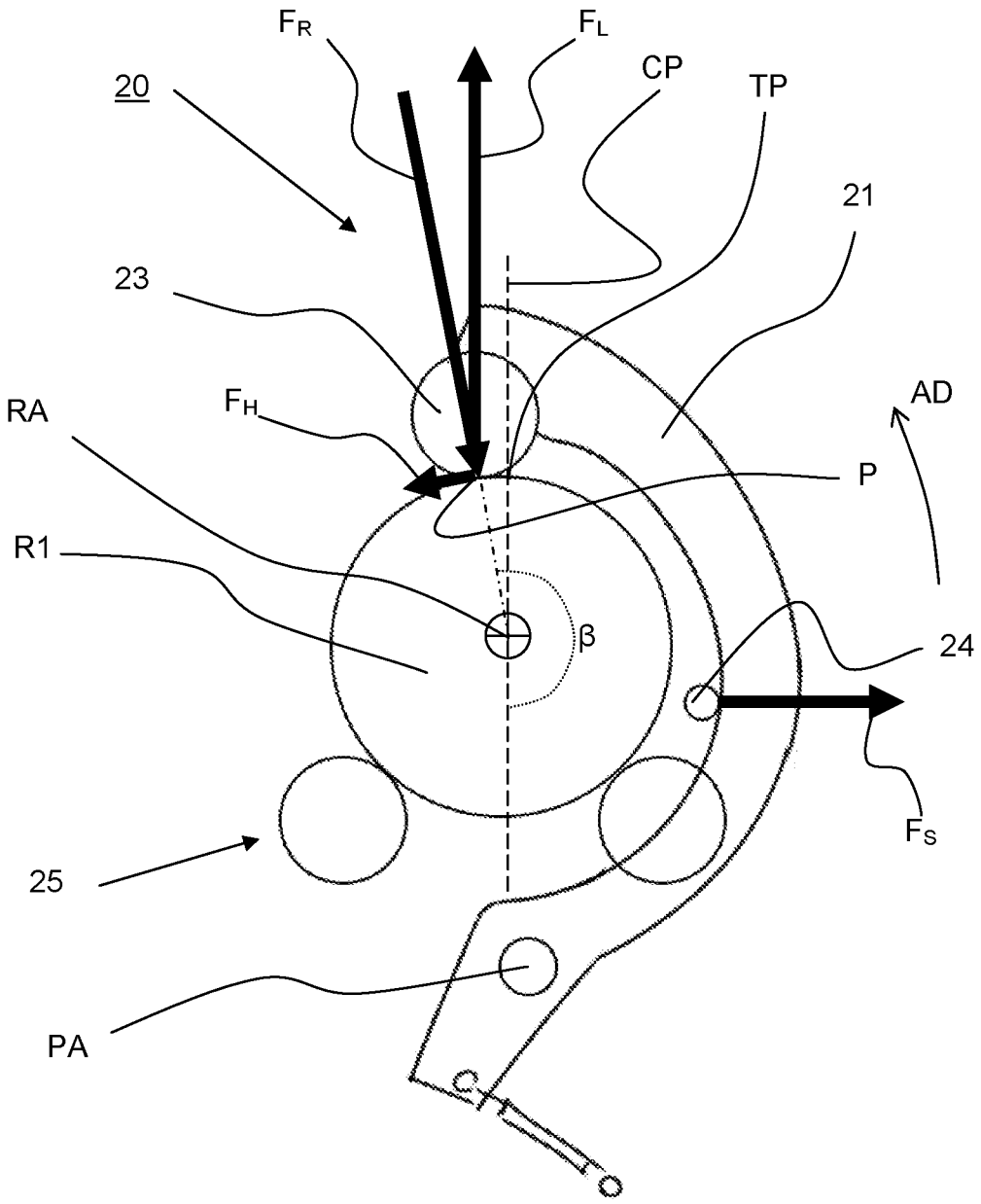
FIG. 4 is a schematic side view of the media roll holder assembly of FIG. 2 further comprises force arrows illustrating the forces acting in the assembly.

FIG. 4 illustrates the workings of the media roll holder assembly 20 by depicting relevant the forces acting on the media roll holder assembly 20. During printing, the medium on the roll R1 is unspooled along the transport path. Pulling forces on the medium exert a lifting force $F_L$ on the roll R1. The lifting force $F_L$ is directed in the feeding direction 30 of the transport path, which in FIG. 4 is the vertically upward direction. While in FIG. 4, the central plane CP is defined by the pivot axis PA and the rotation axis RA is aligned in the transport direction, a non-aligned configuration may also be applied. The lifting force $L_F$ on the roll R1 induces a reaction force $F_R$ from the holding element 23 on the roll R1 at the contact point P. This reaction force $F_R$ is directed radially with respect to the rotation axis RA, i.e. from the contact point P to the rotation axis RA. In consequence of the reaction force $F_R$ the holding element 23 experiences a holding force with a component $F_H$ in the first angular direction AD. This angular holding force $F_H$ urges the holding element 23 in the first pivoting direction PD1 (to the left in FIG. 4). The first pivoting direction PD1 drives the holding element 23 closer to the rotation axis of the roll R1, thus urging the holding element 23 onto the roll R1. The holding element 23 as such keeps the roll R1 secured on the support 25 due to the curvature of the pivotable arm 21 which curves from the pivot axis PA below the support 25 around the roll R1 over a second angle β larger than a semicircle. The pivotable arm 21 experiences a force in the first pivoting direction PD1 due to its attachment to the holding element 23 while the holding element 23 is urged in the first angular direction by the holding force $F_H$. In reaction, the stop element 24 exerts a stop force $F_S$ on the pivotable arm 21 to counter the holding force $F_H$. Thereby, the position of the holding element 23 is static while still being arranged to exert the holding force $F_H$ on the roll R1 in consequence of a lifting force $F_L$. Thereby, a structurally simple holding mechanism 20 for rolls in web-based printers 1 is provided, which mechanism 20 is able to withstand large forces due to its force-balanced holding configuration.

Figure 5:
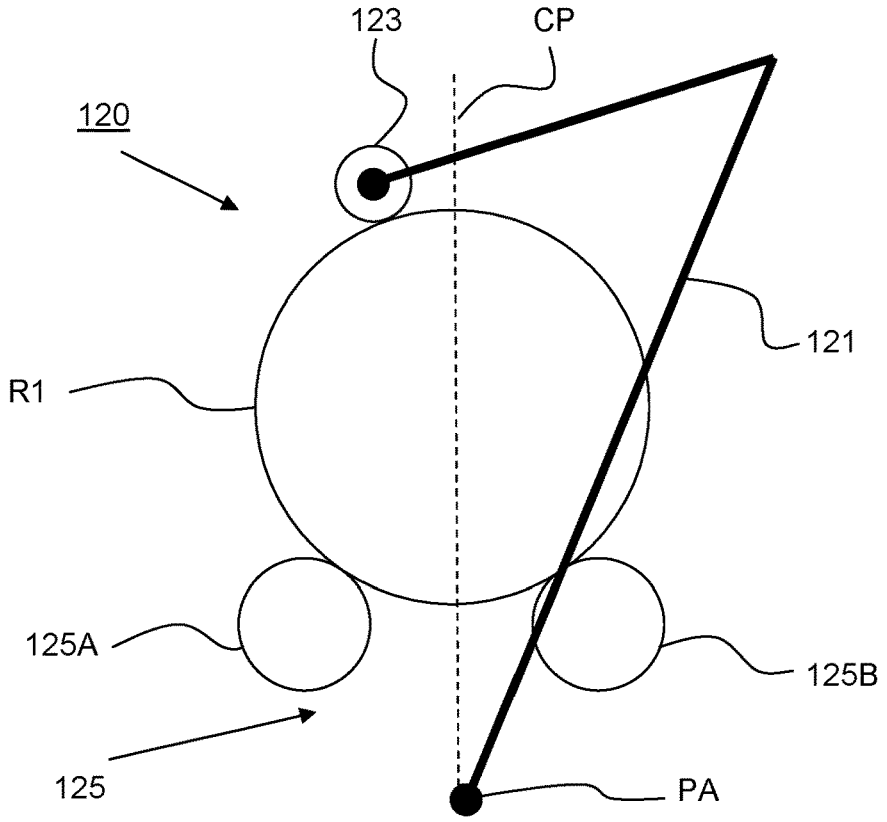
FIG. 5 is a schematic side view of another embodiment of a media roll holder assembly according to the present invention during operation.

FIG. 5 shows a further embodiment of an assembly 120 according to the present invention. The assembly in FIG. 5 is configured similar to that in FIGS. 2 to 4 with the exception of the pivotable arm 121. A first section of the pivotable arm 121 extends from the pivot axis PA along a first side of the central plane CP to a first point, formed in FIG. 5 by the bend or curve in the pivotable arm 121. The first point is preferably position beyond the periphery of the roll R1. A second section of the pivotable arm 121 extends from the bend through the central plane CP. The section portion extends to the second side of the central plane to position the holding element 123 angularly offset from the central plane CP. As described above, the roll R1 is clamped when a lifting force is exerted on the roll R1, as the holding element 123 is then urged in the first angular direction AD. The first and section sections are configured such that a pivoting of the arm 121 in the first pivoting direction drives the holding element 123 onto the roll R1.

Figure 6:
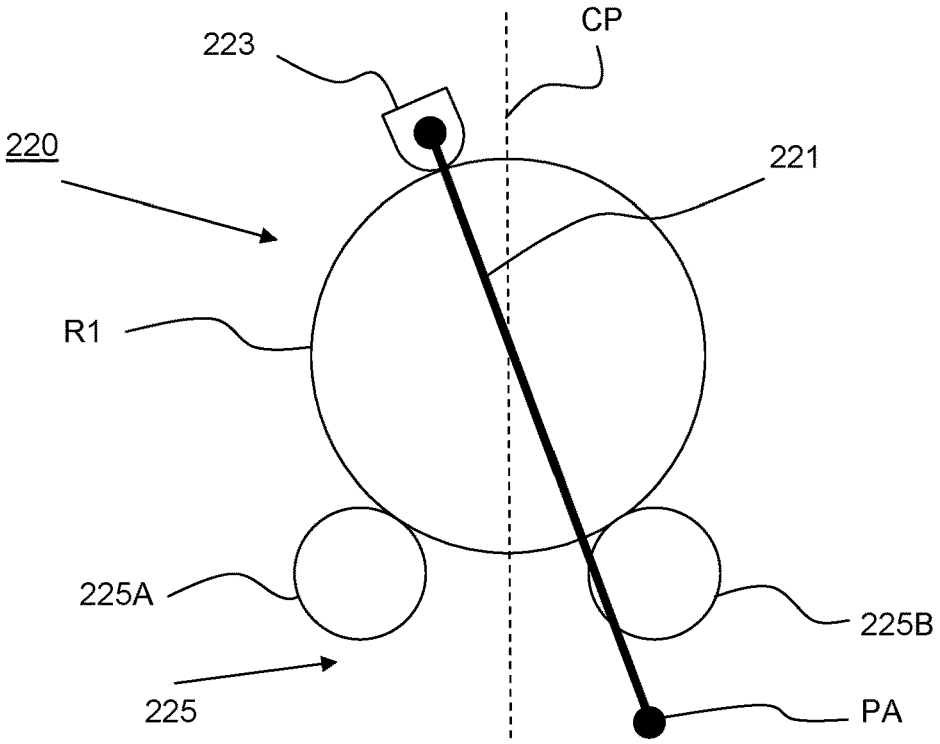
FIG. 6 is a schematic side view of a further embodiment of a media roll holder assembly according to the present invention during operation.

FIG. 6 shows another embodiment of an assembly 220 according to the present invention, wherein the pivotable arm 223 extend from the pivot axis PA on one side of the central plane PA, through the central plane PA, to the other side of the central plane PA. The central plane PA extends in the feeding direction 30 through the rotation axis of the roll R1. The arm 221 positions the holding element 223 angularly displaced from the central plane PA on the other side of the central PA. Again the arm 221 is positioned and shaped such that pivoting in the first pivoting direction PD1 drives the holding element 221 against the roll R1. The holding element 223 in FIG. 6 is configured with a low friction or substantially frictionless contact surface which allows the roll R1 to slide along it without little to none resistance or friction.

Figure 7:
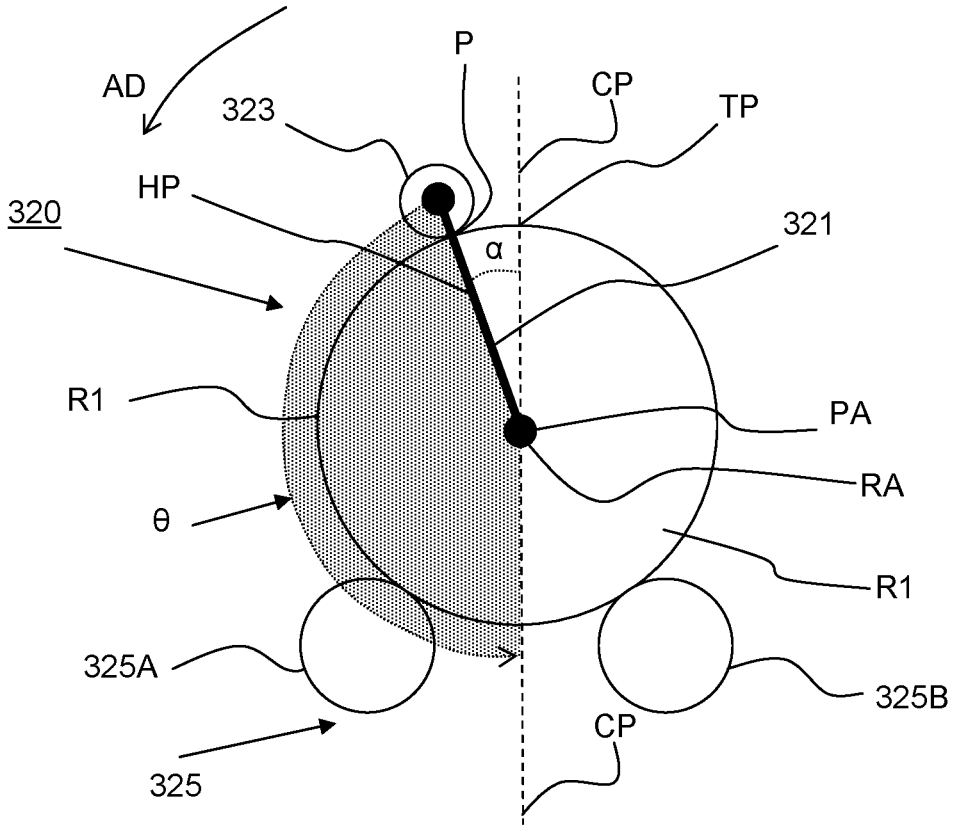
FIG. 7 is a schematic side view of an even further embodiment of a media roll holder assembly according to the present invention during operation.

From the first point, the and the rotation axis RA of the roll R1 in the operative position define a central plane CP, such that the pivotable arm 221 extends from the pivot axis PA along a first side with respect to the central plane CP, through the central plane CP to a second side with respect to the central plane CP, such that the pivotable arm 221 positions the holding element 223 at the periphery of the roll R1 in the holding position HLD FIG. 7 illustrates an even further embodiment of an assembly 320 according to the present invention. In FIG. 7, the pivot axis PA is positioned on or is aligned with the rotation axis RA of the roll R1, which is within the angular range θ. The angular range θ is illustrated by the dotted area and extends radially outward from the rotation axis RA. As in the other embodiments, the borders or edges of the angular range θ are thus defined or formed by the central plane CP and the holding plane HP, which extend radially from their intersection at the rotation axis RA. The angular range θ is positioned on the other side of the holding plane HP as the holding angle α. The holding angle α is the small angle α extending from and the central plane CP to the holding plane HP, or from the top point TP to the contact point P, in the angular direction AD. Likewise, the angular range θ extends from the holding plane HP to the central CP in the angular direction AD.

The embodiment in FIG. 7 results in a compact construction. In FIG. 7, the pivot arm 321 is optimally positioned for generating the holding force $F_H$, as the pivot arm 321 extends radially. The pivot arm 321 and the holding plane HP are then aligned, optimizing the amount of holding force $F_H$ generated in the angular direction AD.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combinations of such claims are herewith disclosed.

Further, it is contemplated that structural elements may be generated by application of three-dimensional (3D) printing techniques. Therefore, any reference to a structural element is intended to encompass any computer executable instructions that instruct a computer to generate such a structural element by three-dimensional printing techniques or similar computer controlled manufacturing techniques. Furthermore, such a reference to a structural element encompasses a computer readable medium carrying such computer executable instructions.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A media roll holder assembly for a roll that is detachably supported in a printing system, the assembly comprising:

a support positioned to support the roll in an operative position, such that the roll is arranged to rotate around a rotation axis;

a holding element positionable in a holding position at a periphery of the roll to engage the roll at a contact point for rotatably holding the roll on the support;

a pivotable arm on which the holding element is provided, the pivotable arm being configured to pivot around a pivot axis, wherein the holding element in the holding position is angularly positioned at an angle of at least 180° from the pivot axis with respect to the rotation axis, as measured around the rotation axis from the pivot axis to the holding element in a first pivoting direction, wherein when the pivotable arm moves in the first pivoting direction, the holding element is urged to move towards the rotation axis.

2. The media roll holder assembly according to claim 1, wherein during use the support supports a lower half of the roll and the holding element in the holding position is positioned at a top half of the roll.

3. The media roll holder assembly according to claim 1, wherein the pivotable arm is configured, such that a lifting force on the roll results in a holding force on the holding element in the holding position in a first angular direction, which holding force urges the pivotable arm in the first pivoting direction, thereby urging the holding element against the roll for clamping the roll between the holding element and the support.

4. The media roll holder assembly according to claim 1, wherein the pivotable arm is configured to pivot around the pivot axis, such that in a first pivoting direction the distance between the holding element and the rotation axis of the roll is decreased.

5. The media roll holder assembly according to claim 1, wherein the pivotable arm extends from the pivot axis along a first side with respect to a central plane extending in a feed direction wherein a web leaves the roll, through the central plane to a second side with respect to the central plane, such that the pivotable arm positions the holding element at the periphery of the roll in the holding position.

6. The media roll holder assembly according to claim 1, wherein the majority of the pivotable arm extends on the first side with respect to the central plane.

7. The media roll holder assembly according to claim 1, wherein the holding element in the holding position is positioned angularly offset with respect to a top point positioned on a periphery of the roll, said top point being positioned on an opposite side of the roll with respect to the support.

8. The media roll holder assembly according to claim 1, wherein the angle is between 180° and 270° with respect to the rotation axis.

9. The media roll holder assembly according to claim 1, wherein the support comprises a pair of rotatable support wheels angularly spaced apart from one another with respect to a rotation axis of the roll in the operative position.

10. The media roll holder assembly according to claim 1, wherein the holding element comprises a holding wheel provided rotatably on the pivotable arm.

11. The media roll holder assembly according to claim 9, further comprising an urging element for urging the pivotable arm into the holding position.

12. The media roll holder assembly according to claim 1, further comprising a stop element for contacting the pivotable arm to limit an angular pivoting range of the pivotable arm in the first pivoting direction.

13. The media roll holder assembly according to claim 1, wherein the pivotable arm is positioned laterally to a side of the transport path, wherein the support and a pivot axis for the pivotable arm are positioned below the roll with respect to the transport path, and wherein the pivotable arm is curved partially around the roll from the pivot axis past a top point on the roll with respect to the transport path.

14. The media roll holder assembly according to claim 1, wherein the holding element and the pivot axis are positioned on opposite sides of a central plane extending through the rotation axis of the roll in the feeding direction, such that the pivotable arm extends through the central plane to position the holding element in the holding position on the roll.

15. The media roll holder assembly according to claim 1, wherein pivot axis and the holding element in the holding position are positioned on opposite sides of a horizontal plane extending through the rotation axis.

16. The media roll holder assembly according to claim 15, wherein the support is positioned on the same side of the horizontal plane as the pivot axis.

17. The media roll holder according to claim 16, wherein the pivotable arm substantially follows the circumference of the roll over the at least 180° angle.

18. The media roll holder according to claim 17, wherein during use an effective diameter of the pivotable arm over the at least 180° angle is greater than a diameter of the roll.

19. The media roll holder according to claim 14, wherein the pivotable arm is substantially C-shaped.

20. Printing system for printing web media, comprising a media roll holder according to claim 1.

21. The media roll holder assembly according to claim 1, wherein the pivotable arm extends in an arc of at least 180° between the pivot axis and the holding element.

* * * * *